US006255569B1

(12) United States Patent
Ward

(10) Patent No.: US 6,255,569 B1
(45) Date of Patent: Jul. 3, 2001

(54) HOLDER FOR GUITAR SLIDE

(76) Inventor: James Gary Ward, 1890 Ashway Dr., Cumming, GA (US) 30040

( * ) Notice: Subject to any disclaimer, the term of this patent is extended or adjusted under 35 U.S.C. 154(b) by 0 days.

(21) Appl. No.: 09/547,252

(22) Filed: Apr. 11, 2000

(51) Int. Cl.[7] ..... G10D 3/00

(52) U.S. Cl. ..... 84/329; 84/319; 84/327; 84/421

(58) Field of Search ..... 84/329, 319, 327, 84/421; 248/309.1, 313, 316.1, 316.7

(56) References Cited

U.S. PATENT DOCUMENTS 350,209 * 10/1886 Parmelee ..... 411/400
3,224,721 * 12/1965 Malmquist ..... 248/339
4,531,443 * 7/1985 Gillis, Jr. ..... 84/329
4,790,232 * 12/1988 Rosen ..... 84/329
4,943,183 * 7/1990 Nakano ..... 248/74.2

* cited by examiner

*Primary Examiner*—Shih-Yung Hsieh
(74) *Attorney, Agent, or Firm*—D. Peter Hochberg; Katherine R. Vieyra; William H. Holt

(57) ABSTRACT

A holder for a guitar slide having a first elongated rod portion for receiving a guitar slide, the first rod portion having an open end and a closed end, and a second rod portion extending from the closed end of the first rod portion and being generally perpendicular to the first rod portion, the second rod portion including a threaded end opposite an end extending from the closed end of the first rod portion where the threaded end is for securing the holder to a vertical surface. A holding device is provided for attaching the guitar slide holder to a microphone stand or a vertical surface.

2 Claims, 1 Drawing Sheet

HOLDER FOR GUITAR SLIDE

BACKGROUND OF THE INVENTION

1. Field of the Invention

The present invention relates generally to holders for accessories for musical instruments, and more particularly, to a holder for securing a guitar slide.

2. Description of Prior Art

In general, guitar players use one hand to press strings down on the neck of a guitar, and hold a pick in the other hand for strumming the strings at the base of the guitar to produce musical sounds. Guitar slides are used by performers that choose to play their guitar using a slide for pressing down strings along the neck of a guitar to produce very unique musical sounds. The problem with these slides is that they are small and very easy to lose or misplace. The slides are generally cylindrical in shape and made of polished metal or glass. Guitarists need a place where they can easily and quickly place the slide during the performance or practice of a song. Since slides are generally cylindrical in shape, they tend to roll off of a flat surface. This forces the guitarist to place the slide in an inconvenient place such as in a pocket or propped against something on top of a guitar amplifier, thus hindering easy access.

U.S. Pat. No. 4,790,232 discloses a holder for a guitar slide and pick having a generally rectangular base, and an oblong shaped arm extending from the top surface of the base, for receiving and holding a guitar slide. An adhesive is necessary for mounting the guitar slide holder to a guitar. The problem with this holder is that the arm requires complicated manufacturing. Additionally, the arm can be easily broken or moved by pulling the slide with too much force, or accidentally bumping the slide and dislodging it from the holder. Adhesives lose their adhering properties over time and in high temperatures, such that the guitar slide holder may fall off of the guitar with the guitar slide. Small amounts of force, such as that occurring in bumping against the holder, could cause the holder to become dislodged. This results in the loss of both the holder and the guitar slide. Removing the adhesive from the guitar surface could damage the finish. Most guitarists greatly value the appearance of their instruments.

U.S. Pat. No. 5,299,485 discloses a guitar pick and slide holder that can be mounted to a guitar support strap. The combined pick and slide holder includes a generally rectangular body having a predetermined thickness. One side of the holder has a first and second guitar pick holder compartment. A cutout is provided near the other side of the holder forming a finger dimensioned to receive a guitar slide. Small holes are provided for screwing the holder to a guitar support strap. A larger holder is provided for temporarily storing a cigarette during performance. This slide holder requires additional parts (i.e. screws) to be used to mount the slide holder. Additionally, the guitar slide can easily become dislodged by bumping or setting down the guitar during nonuse because the holder is not retained in a vertical position. Removing the adhesive from the guitar surface could damage the finish. Most guitarists greatly value the appearance of their instruments.

The present invention alleviates the problems with the aforementioned prior art by providing a rigid guitar slide holder with a threaded end that always maintains the guitar slide in a vertical position. The guitar slide holder of the present invention allows the guitarist to place the slide in a very secure and very convenient place, thus ending the danger of a broken or lost slide with the subsequent inconvenience and monetary cost of replacement. It also enhances the guitarist's performance by being conveniently placed where the player needs it the most.

SUMMARY OF THE INVENTION

In accordance with a preferred embodiment of the present invention, the invention is a holder for a guitar slide having a first elongated rod portion for receiving a guitar slide, the first rod portion having an open end and a closed end, and a second rod portion extending from the closed end of the first rod portion and being generally perpendicular to the first rod portion, the second rod portion including a threaded end opposite an end extending from the closed end of the first rod portion, wherein the threaded end is for securing the holder to a vertical surface.

In a preferred aspect of the invention, the preferred embodiment further includes a collar disposed near the threaded end of the second rod portion for limiting the turns necessary to secure the threaded end to the vertical surface, and for providing an engagement surface for engaging the vertical surface.

In another preferred aspect of the invention, a holding device is provided for securing the holder to a microphone stand, the holding device including an aperture for threadingly receiving the threaded end of the second end portion. The holding device may be comprised of a cylindrically shaped hollow body portion having an open section forming a first and second side and an end portion extends inwardly from each side of the open section. The end sections should be comprised of a resilient material.

In yet another preferred aspect of the invention, the end portions are comprised of a first convex portion extending from one of the sides of the open section, a concave portion extending from the first convex portion, and a second convex portion extending.

An object of the invention is to provide a guitar slide holder that retains the slide in a vertical position.

Another object of the invention is to provide a guitar slide holder that does not require additional hardware or adhesive for mounting the holder.

Another object of the invention is to provide a guitar slide holder that is simple in construction, and inexpensive to manufacture.

Another object of the invention is to provide a guitar slide that is rigid, durable and difficult to break or bend.

Another object of the invention is to provide a holding device for attaching the guitar slide to a microphone stand.

Yet another object of the invention is to provide a holding device that can be easily attached and removed from the microphone stand.

Yet still another object of the invention is to provide a holding device that can be easily attached to a vertical surface.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, preferred embodiments of which will be described in detail in the specification and illustrated in the accompanying drawings which form a part hereof, and wherein.

DETAILED DESCRIPTION OF PREFERRED EMBODIMENT

Figure 2:
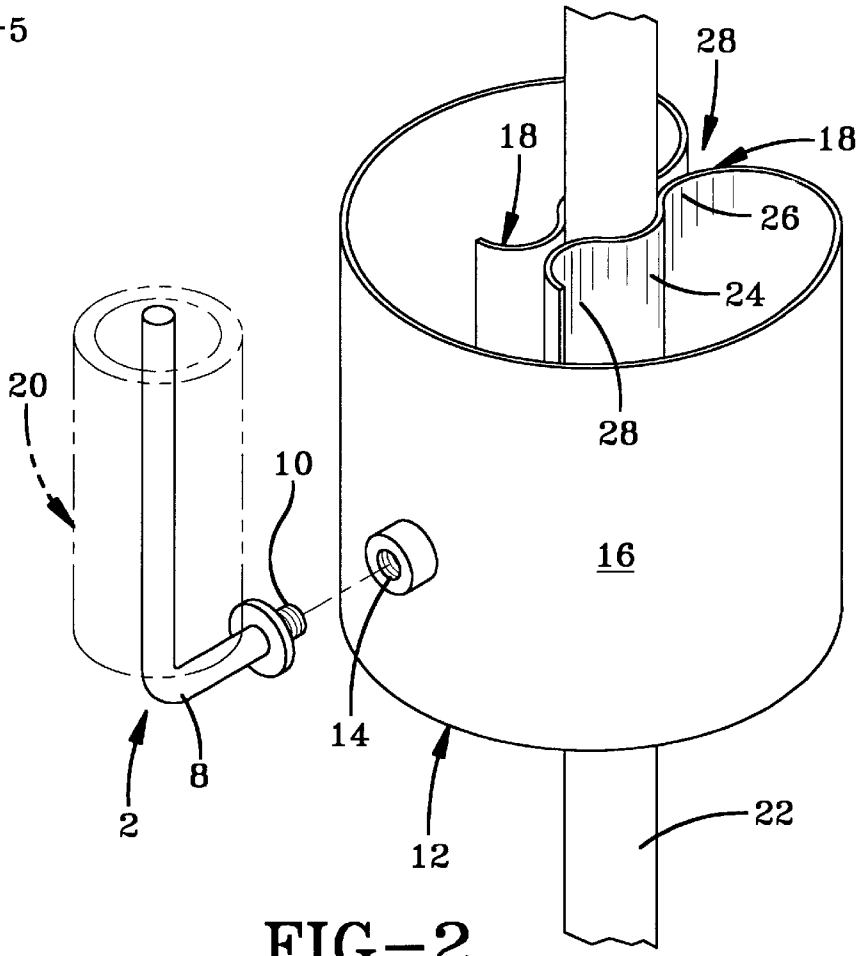
FIG. 2 is a front top perspective view of the preferred embodiment of the invention attached to a holding device for a microphone holding a guitar slide shown in ghost lines to a microphone stand.
Figure 1:
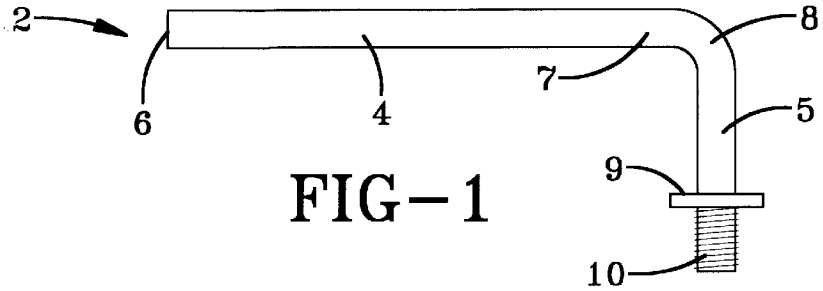
FIG. 1 is a front view of a preferred embodiment of the invention.

Referring now to the drawings wherein the showings are for the purpose of illustrating the preferred embodiment of the invention only, and not for the purpose of limiting same, FIG. 1 shows a L-shaped rod 2. L-shaped rod 2 has an elongated rod portion 4 and a shorter rod portion 5. Elongated portion 4 has a free end 6 and an opposite end 7 disposed at a juncture 8 with shorter rod portion 5. Shorter rod portion extends from end 7 of elongated rod portion 4 and juncture 8 to a collar 9. Attached to the other side of collar 9 is an attachment end 10. The L-shaped rod member may be made of metal, glass, plastic, composite or a combination of these materials. Attachment end 10 can be attached to practically any vertical surface such as a wall, a chair, a bench, or a guitar. End 10 can advantageously be threaded for attachment to a correspondingly threaded bore. After attachment of end 10, elongated rod portion 4 runs upward and parallel to the vertical surface, so that a guitar slide can be slid to rest on L-shaped rod 2 during non-use.

In a preferred aspect of the invention, L-shaped rod member 2 is affixed to a holding device 12 for attaching to a microphone stand 22. Attachment end 10 can be attached to support means in device 12. If end 10 is threaded, device 12 can have an aperture 14 with internal threads for engaging the threads of end 10 to hold device 12 in place. It should be appreciated that holding device 12 could be comprised of a material softer than threaded end 10, such that the threaded end 10 is self threading.

Holding device 12 includes a body portion 16 having a gap or open section or receptacle 28 apart from the area where L-shaped rod member 2 is attached to the holding device. In its preferred form, receptacle 28 comprises two S-shaped end portions 18 extending inwardly from the outer part of body portion 16 at opposite sides of the open section. End portions 18 are formed into a first convex portion 26 extending from the open section of body portion 16, a concave portion 24 extending from first concave portion 26, and a second convex portion 28 extending from concave portion 24. Holding device 12 could be a single integral device made of a single material, or end portions 18 could be made of a different material than body portion 16. Portions 18 thus form grasping members.

Importantly, end portions 18 are made of a resilient material, so that when sliding holding device 12 onto microphone stand 22 from a horizontal direction, first convex portions 26 of both sides will yield and allow microphone stand 22 to pass to concave portion 24, where ends 18 will return to their original position and keep holding device 12 fixed to microphone stand 22. This material could be plastic, rubber, or a thin piece of metal. Although shown as from sheet material, it could be made from bulkier material such as resilient plastic foam. Once the holding device is affixed to stand 12, guitar slide 20 shown in ghost lines, can be slid over the elongated portion 4 and be left to rest on short rod portion 6 until the guitar slide is needed. Easy removal of holding device 12 is accomplished by pressing each of second concave portions 28 toward one another using the index finger and thumb. This causes convex portions 26 to separate and facilitates easy removal of holding device 12 from microphone stand 22. It is envisioned that the aforementioned elements of L-shaped rod member 2 or holding device 12 made from metal will be coated with a protective coating to protect guitar slide 20 and microphone stand 22 from scratches and damage as guitar slide 20 and holding device 12 are attached and removed from microphone stand 20.

Figure 3:
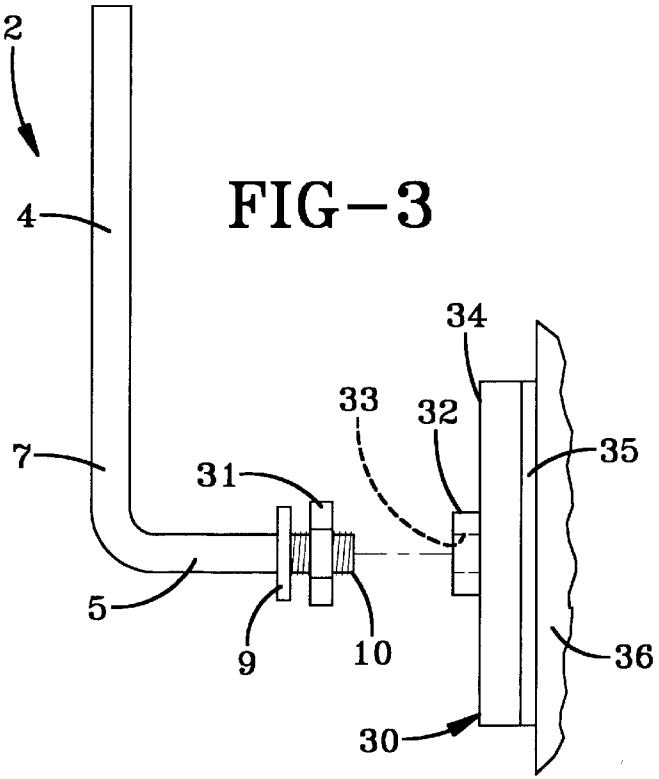
FIG. 3 is a side view of a preferred embodiment of the invention attached to a holding device for attachment to a vertical surface for holding a guitar slide.

In an alternate aspect of the invention, as shown in FIG. 3, L-shaped rod member 2 is affixed to a holding device 30 for attachment to a vertical surface 36 such as a wall. Attachment end 10 can be attached to an annular ridge 32 located in the center of and on the front side of plate 34 using suitable attachment means. If end 10 is threaded, annular ridge 32 can have a correspondingly threaded bore 33 formed in it for engaging the threads of end 10 to hold L-shaped rod member 2 in place. A locknut 31 is used to lock the L-shaped rod member 2 in a desired position by tightening locknut 31 against annular ridge 32. The rear side of plate 34 is attached to a vertical surface 36 with double-sided tape 35. In this fashion, holding device 30 can be attached to virtually any vertical surface to hold L-shaped rod member 2 in place for holding a guitar slide 20. Plate 34 with annular ridge 32 can be formed from any suitable material such as metal or plastic.

The foregoing description is a specific embodiment-of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A holder for a guitar slide, said holder comprising:

a first elongated rod portion for receiving a guitar slide, said first rod portion having a free end and opposite end;

a second rod portion extending from said opposite end of said first rod portion and being generally transverse to said first rod portion, said second rod portion including an attachment end opposite an end extending from said opposite end of said first rod portion, for securing said holder to a vertical surface; and a holding device for securing said holder to the vertical surface, said holding device including an attachment device for cooperating with said attachment end to support said holder on the vertical surface, wherein said attachment device comprises threads on said attachment end and a correspondingly threaded bore formed in an annular ridge located on a front side of a plate for receiving said attachment device.

2. A holder according to claim 1, and further comprising a locknut to lock said holder in a desired position by tightening said locknut against said annular ridge.

* * * * *